US006472999B1

(12) United States Patent
Lin

(10) Patent No.: US 6,472,999 B1
(45) Date of Patent: Oct. 29, 2002

(54) APPARATUS AND METHOD FOR REMOTE CONVENIENCE MESSAGE RECEPTION WITH SIGNAL STRENGTH DETERMINATION

(75) Inventor: Xing Ping Lin, Waterford, MI (US)

(73) Assignee: TRW Inc., Lyndhurst, OH (US)

( * ) Notice: Subject to any disclaimer, the term of this patent is extended or adjusted under 35 U.S.C. 154(b) by 0 days.

(21) Appl. No.: 09/264,555

(22) Filed: Mar. 8, 1999

(51) Int. Cl.[7] ..... G08C 21/00

(52) U.S. Cl. ..... 340/825.69; 340/3.55; 340/526; 340/825.72; 340/825.57; 340/825.65; 340/5.64

(58) Field of Search ..... 340/511, 5.61, 340/825.69, 825.65, 3.55, 526, 10.1, 10.33, 10.4, 10.42, 572.1, 825.72, 825.57, 5.64, 5.72; 455/226.2, 134

(56) References Cited

U.S. PATENT DOCUMENTS

| | | | | | |
|---|---|---|---|---|---|
| 3,579,205 | A | * | 5/1971 | Akashi | 340/825.65 |
| 3,914,762 | A | * | 10/1975 | Klensch | 340/5.61 |
| 4,965,548 | A | * | 10/1990 | Fayfield | 340/511 |
| 5,193,210 | A | | 3/1993 | Nicholas et al. | |
| 5,396,224 | A | * | 3/1995 | Dukes et al. | 340/825.49 |
| 5,420,568 | A | | 5/1995 | Iida et al. | 340/825.69 |
| 5,600,323 | A | * | 2/1997 | Boschini | 340/825.69 |
| 5,686,883 | A | | 11/1997 | Mutoh et al. | 340/426 |

OTHER PUBLICATIONS

Pending U.S. Lin et al. Patent Application Ser. No. 09/255,321, filed Feb. 23, 1999 entitled Apparatus and Method for Remote Convenience Message Reception with Adjustable Pulse Detection Receiver Portion, Atttorney Docket No. TRW(TE)4123.

* cited by examiner

*Primary Examiner*—Michael Horabik
*Assistant Examiner*—Hung Dang
(74) *Attorney, Agent, or Firm*—Tarolli, Sundheim, Covell, Tummino & Szabo L.L.P.

(57) ABSTRACT

An apparatus (14) and an associated method determine signal strength of a received electromagnetic signal (18) that is comprised of a plurality of pulses that convey a remote convenience function request, and which causes performance of the requested function. A comparator (82) has a first input for receiving an electrical signal (78) with a voltage that varies to convey the remote convenience function request. A second input of the comparator (82) receives a threshold voltage value reference signal (86). An output of the comparator (82) provides an output signal (46) that indicates the occurrence of the voltage of the electrical signal (78) exceeding the threshold value of the reference signal (86). A microprocessor (100) and a threshold change trigger (122) of a controller portion (48) adjust the threshold voltage value of the reference signal (86). A microprocessor (52) and a count memory (126) of the controller portion (48) monitor the output signal (46) of the comparator (82) during adjustment of the threshold voltage value of the reference signal (86) to determine strength of the electromagnetic signal (18).

6 Claims, 4 Drawing Sheets

APPARATUS AND METHOD FOR REMOTE CONVENIENCE MESSAGE RECEPTION WITH SIGNAL STRENGTH DETERMINATION

FIELD OF THE INVENTION

The present invention relates to remote convenience systems, and is particularly directed to systems that have an ability to determine signal strength.

BACKGROUND OF THE INVENTION

Remote convenience systems are known in the art. Such remote convenience systems permit remote control of certain functions. One example type of a remote convenience system is for remotely controlling vehicle functions. Other example types of remote convenience systems include garage door opener systems and entry light activation systems. Focusing on the remote convenience vehicle systems, remotely controlled vehicle functions include locking and unlocking functions of one or more vehicle doors. A remote convenience system that permits remote locking and unlocking is commonly referred to as a remote keyless entry system. Such remote convenience vehicle systems may provide for control of other vehicle functions. For example, a remote vehicle locator function may be provided. The vehicle locator function causes a horn to emit a horn chirp and/or the headlights of the vehicle to flash "ON". This allows a person to quickly locate their car within a crowded parking lot.

Known remote convenience vehicle systems include a receiver/controller unit mounted in an associated vehicle and at least one portable hand-held transmitter unit located remote from the receiver/controller unit. Each transmitter unit is provided with one or more manually actuatable switches. Each switch is associated with a vehicle control function to be performed. The transmitter unit includes circuitry that responds to the actuation of one of the switches to transmit a function request message, along with a security code, in the form of a digital signal. A signal that is received by the receiver/controller unit is processed such that the vehicle performs the requested function.

The remote convenience systems operate in the ultrahigh frequency (UHF) portion of the radio frequency (RF) spectrum. Specifically, the signals from the transmitter units are in the UHF portion of the spectrum that is allocated by the United States Federal Communications Commission (FCC) for unlicensed transmission devices. FCC regulations stipulate that such unlicensed devices cannot have a transmitted signal strength that exceeds a preset maximum. Some countries other than the United States only permit very low levels of transmitted power. The transmitted power level in these countries is lower than the permitted level in the United States. For example, in Japan, remote convenience transmitter units have typical transmission power levels 30 dB below that of a typical United States remote convenience transmitter unit. In addition, within the United States, FCC regulations stipulate that the unlicensed devices must not cause undo radio interference and must operate despite the presence of any radio interference.

Often, it is desirable to accomplish remote control performance of certain functions at a longest possible distance. One example of such a function that is to be performed at the longest possible distance is the remote vehicle locator function. To illustrate such a scenario, consider a shopping mall patron exiting a shopping mall building and being faced with the task of visually locating their car within a vast shopping mall parking lot. It is beneficial to be able to actuate the remote vehicle locator function from a location near the exit door of the shopping mall, before proceeding into the parking lot.

Another example of a remote function that is to be performed at a longest possible distance is the door lock function. Thus, if an operator has forgotten to lock the vehicle doors and has proceeded away from the vehicle, the doors can be locked without returning to the vehicle.

For some remote control functions, it is desirable to permit performance only when the operator is relatively near the vehicle. One example of a remote function that is to be performed only when the operator is near to the vehicle is the door unlock function. Thus, the vehicle is unlocked only when the operator is near enough to see activity that occurs at the vehicle.

Distance is related to received signal strength. Thus, by determining signal strength, appropriate control can be accomplished.

SUMMARY OF THE INVENTION

In accordance with one aspect, the present invention provides an apparatus for determining signal strength of a received electromagnetic signal comprised of a plurality of pulses that convey a remote convenience function request, and for causing performance of the requested function. A comparator has a first input for receiving an electrical signal with a voltage that varies to convey the remote convenience function request. A second input of the comparator receives a threshold voltage value. An output of the comparator provides an output signal indicative of the occurrence of the voltage of the electrical signal exceeding the threshold value. Means adjusts the threshold voltage value. Means monitors the output signal of the comparator during adjustment of the threshold voltage value to determine strength of the electromagnetic signal.

In accordance with another aspect, the present invention provides a method of determining signal strength of an electromagnetic signal, that is comprised of a plurality of pulses that convey a remote convenience function request and that is intended for causing performance of the requested function. An electrical signal, which has a voltage that varies to convey the remote convenience function request, is compared with a threshold voltage value. An output signal that is indicative of the occurrence of the voltage of the electrical signal exceeding the threshold value is output. The threshold voltage value is adjusted. The output signal is monitored during adjustment of the threshold voltage value to determine strength of the electromagnetic signal.

BRIEF DESCRIPTION OF THE DRAWINGS

The foregoing and other features and advantages of the present invention will become apparent to those skilled in the art to which the present invention relates upon reading the following description with reference to the accompanying drawings, wherein.

DESCRIPTION OF THE PREFERRED EMBODIMENT

Figure 1:
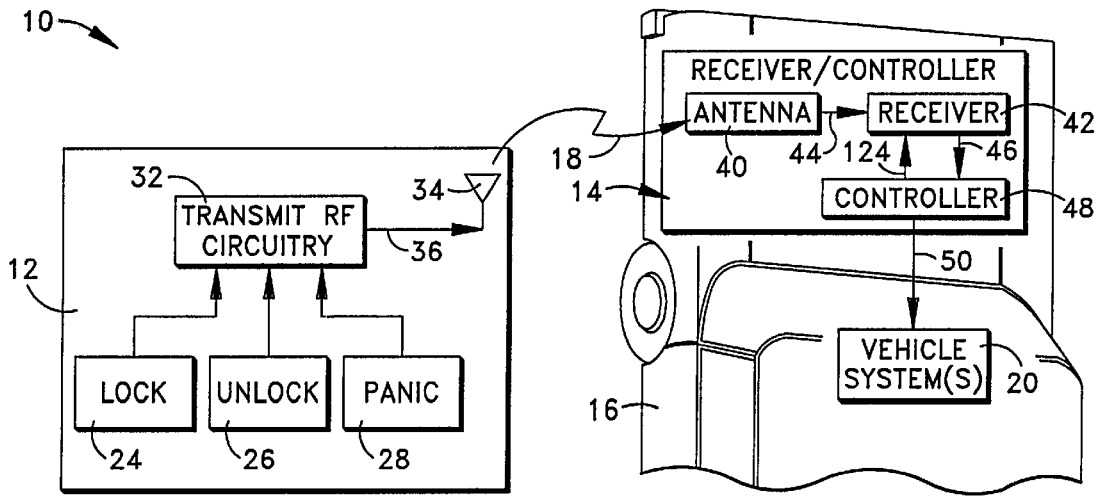
FIG. 1 is a schematic illustration of a remote convenience vehicle system that has components in accordance with the present invention.

A remote convenience vehicle system 10 is schematically shown in FIG. 1. The system 10 includes a transmitter unit 12 and an associated receiver/controller unit 14 that is mounted in a vehicle 16. The transmitter unit 12 is operable to communicate, via an electromagnetic signal 18, with the receiver/controller unit 14 to achieve remote control performance of at least one convenience function (e.g., unlock doors) at a vehicle system 20 (e.g., vehicle door lock actuator) of the vehicle 16. The transmitter unit 12 is operated when it is desired to cause performance of the requested remote convenience function at the vehicle 16.

The transmitter unit 12 is a portable hand-held unit with a housing that encloses its electronic components. The transmitter unit 12 includes at least one manually actuatable pushbutton electric switch. In the example shown in FIG. 1, there are three pushbutton selector switches 24–28. A first pushbutton switch 24 and a second pushbutton switch 26 are associated with door lock and unlock functions, respectively. A third pushbutton switch 28 is associated with a vehicle alarm or "panic" function. It will be appreciated that the system 10 could be configured to control different remote convenience functions (e.g., vehicle locate), and that the transmitter structure (e.g., the number, type, and the location of the pushbutton switches on the transmitter) would be accordingly different.

Each actuation or predefined series of actuations, of one of pushbutton switches (e.g., 24) of the transmitter unit 12 is a request to perform a corresponding predefined remote convenience function. For example, actuating pushbutton switch 24 is a request to lock the doors of the vehicle 16. The pushbutton switches 24–28 are operatively connected to a transmit radio frequency (RF) circuitry 32 within the housing of the transmitter unit 12. The transmit RF circuitry 32 is, in turn, operatively connected to a broadcast transmission antenna 34.

In response to pushbutton actuation, transmit RF circuitry 32 generates/assembles a "packet" of information to be transmitted. The transmission packet includes a start/wake-up portion, a security code, and at least one command that represents the remote function request. The transmit RF circuitry 32 then provides an appropriate electrical signal 36 that conveys the transmission packet to the antenna 34. In response to the stimulus of the electrical signal 36, antenna 34 broadcasts the signal 18, which is intended to be received by the receiver/controller unit 14 at the vehicle 16. Preferably, the transmitted signal 18 is a pulse-width-modulated (PWM) signal that has a radio frequency (RF) carrier frequency. It is to be appreciated that other signal types (e.g., frequency modulation, and frequency shift key) can be used without deviating from the present invention.

Within the receiver/controller unit 14, an antenna 40 is operatively connected to a receiver portion 42. The antenna 40 provides a RF electrical signal 44 that conveys the contents (e.g., a security code and a function request message) of the transmitted signal 18 that has been received. The receiver portion 42 processes the conveyed information and provides a signal 46 to a controller portion 48. Specifically, in one preferred embodiment, the receiver portion 42 includes an amplifier, a mixer that beats the signal with a local oscillator signal, a buffer, and a bandpass filter. Thus, the signal 44 is converted to an intermediate or baseband frequency having a plurality of pulses. Each pulse has amplitude that is dependent upon the strength of the transmitted signal 18.

Within the controller portion 48, the information-conveying pulses are processed by a microprocessor 52 (FIG. 2) to determine if the transmitted signal 18 includes a proper security code and to determine the function that is requested. If the transmitted signal 18 includes the proper security code, the controller portion 48 provides an appropriate signal 50 to the corresponding vehicle system 20 (e.g., door lock actuator system) to cause performance of the requested function.

With regard to the convenience functions that are remotely controlled via the system 10 (FIG. 1), the person of ordinary skill in the art will understand the vehicle system(s) 20 and the operation of such functions, as they are known in the art. Also, the person of ordinary skill in the art will understand the processing of the information regarding security code and function request message portions by the microprocessor 52 (e.g., decoding). Accordingly, detailed descriptions of such systems and functions are not provided herein for brevity. Also, it will be appreciated that the present invention is applicable to other non-automotive, remotely controlled functions (e.g., garage door opening or entry light activation).

Figure 2:
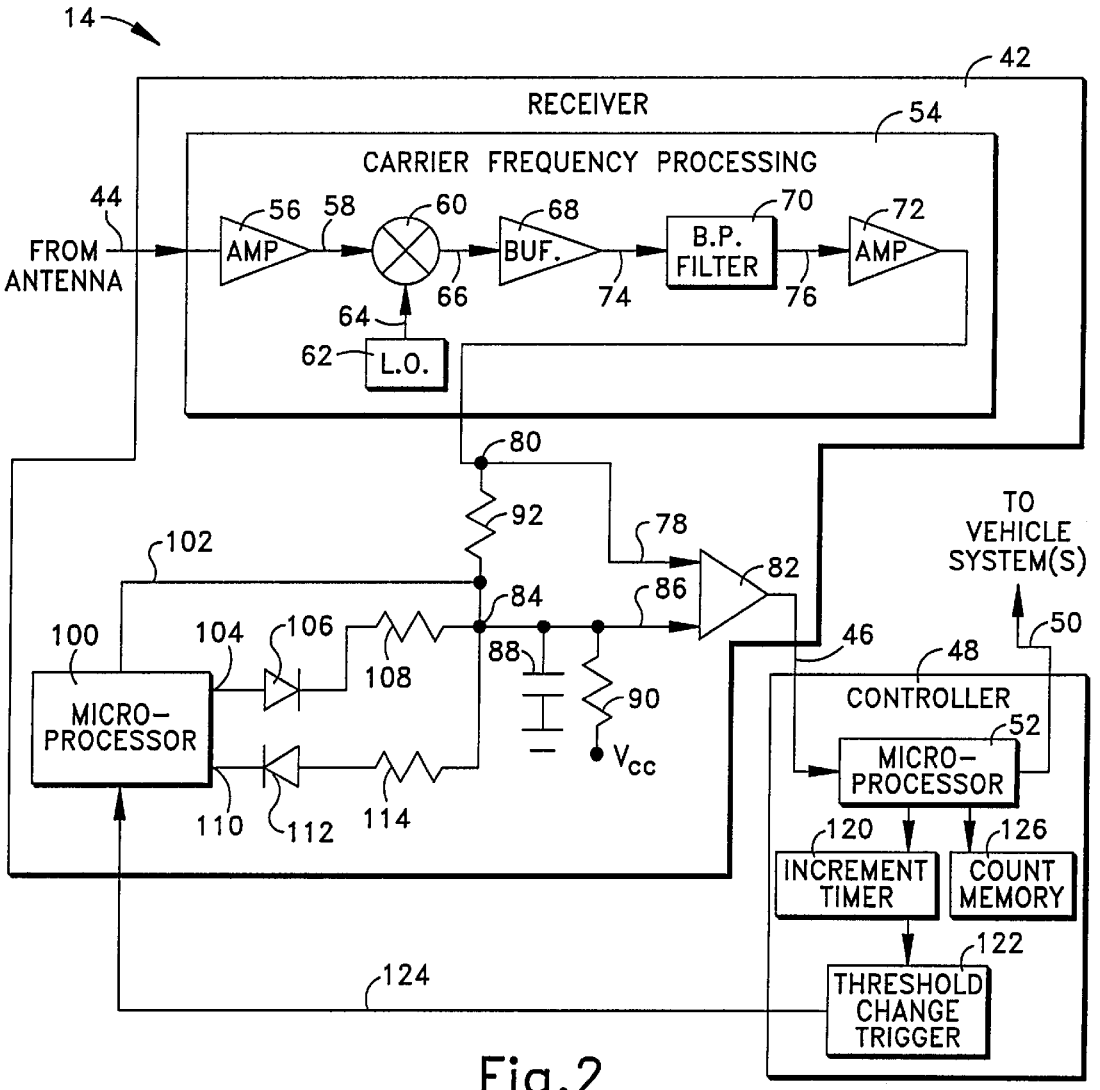
FIG. 2 is a schematic illustration of a receiver/controller unit of the system of FIG. 1.

Within the receiver portion 42, the RF signal 44 provided from the antenna 40 is converted to a lower frequency in order to permit processing. Accordingly, the receiver portion 42 includes carrier frequency processing circuitry 54 (FIG. 2). In one example, the carrier frequency processing circuitry 54 includes a front-end amplifier 56 that receives the RF signal 44 that is output from the antenna 40. A signal 58 output from the amplifier 56 is provided as a first input to mixer 60. A local or reference oscillator 62 provides an oscillating signal 64 at a reference frequency as a second input to the mixer 60.

The mixer 60 combines the two input signals and outputs a signal 66 that has frequency component values that are at the sum and difference of the frequency values of the two input signals. In other words, the mixer 60 "beats" the first input signal 58 with the second input signal 64. The "difference frequency" value is at the IF frequency.

The carrier frequency processing circuitry 54 includes a buffer 68, a bandpass filter 70, and an amplifier 72 for handling the IF frequency signal output from the mixer 60. The buffer 68 receives the signal 66 output from the mixer 60, and provides an output 74 to the bandpass filter 70. The bandpass of the filter 70 is centered on the IF frequency. Thus, other frequency components, such as the "sum frequency" produced in the mixer 60, are removed. The amplifier 72 amplifies a signal 76 output from the filter 70, and provides an IF signal 78, which is the output from the carrier frequency processing circuitry 54 and provided to a first node 80.

It is to be appreciated that the signal 78 is comprised of a series of pulses that convey the contents (e.g., start portion, security code, function request) of the transmitted signal 18. Each pulse of the signal 78 has amplitude that is dependent upon signal strength. Preferably, amplitude is represented by voltage amplitude.

Figure 3:
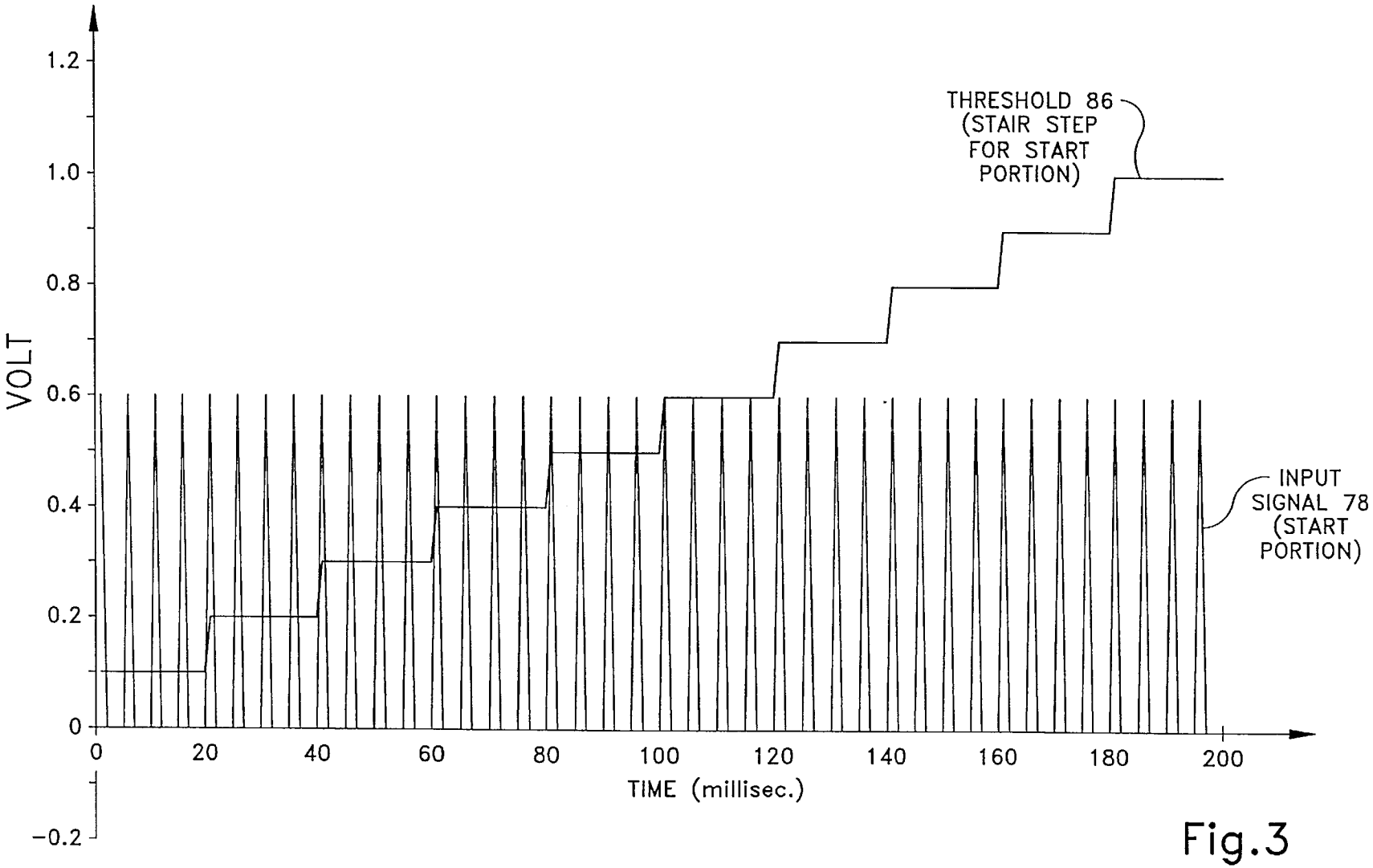
FIG. 3 is a plot of two inputs provided to a comparator of the receiver/controller unit of FIG. 2 during a start portion of a received signal.

FIG. 3 is an example of a plot of a portion of the signal 78. The signal portion happens to correspond to a start portion of the transmitted signal 18. Pulse amplitude happens to be 0.6 volts.

The signal 78 (FIG. 2) output from the carrier frequency processing circuitry 54 must be further processed to differentiate between pulses that convey information and pulses that are the result of noise and the like. Also, this further processing permits transmitted signals 18 that have insufficient strength to be ignored by the receiver/controller unit 14. Thus, only pulses that meet certain criterion are passed alone to the controller portion 48 for decoding, etc. The criterion used to screen-out certain pulses is adjustable and is provided by the structure set forth below.

In particular, the structure for the further processing is a comparator 82, whose output is the signal 46. The first node 80 is connected to a first input terminal of the comparator 82, and the signal 78 is provided as a first input to the comparator. A second node 84 is connected to a second input terminal of the comparator 82, and a reference voltage is supplied as a second input signal 86 to the comparator. In the plot of FIG. 3, a voltage value trace is shown for the signal 86. The voltage happens to change over the course of time. This changing voltage value of the signal is explained below.

Figure 4:
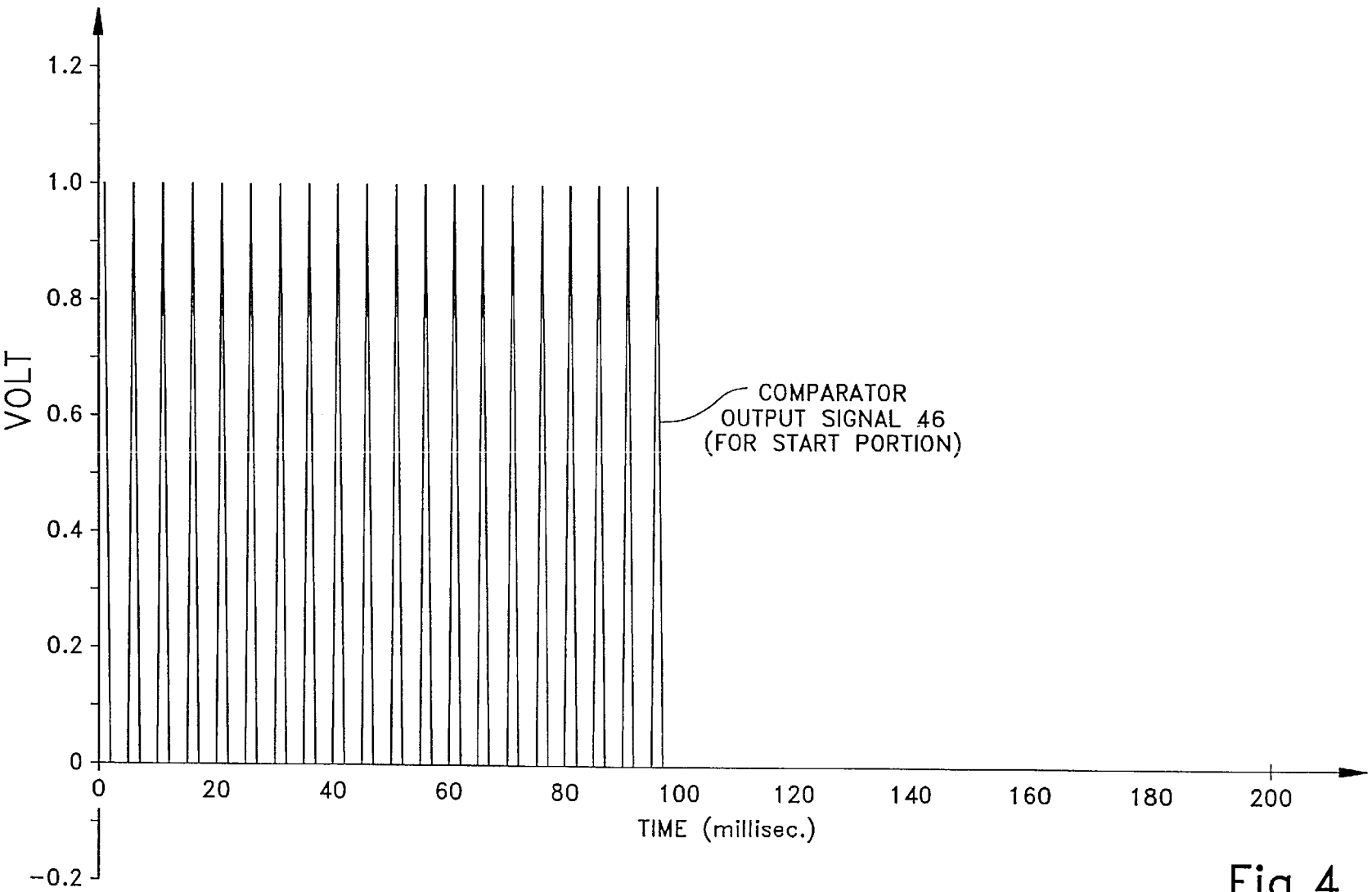
FIG. 4 is a plot of an output of the comparator during the start portion.

When the voltage amplitude of the first input signal 78 is greater than the voltage amplitude of the second input signal 86, the output signal 46 of the comparator 82 is a HIGH (e.g., 1.0 volt as is shown in an example plot of FIG. 4). The duration of the HIGH is dependent upon the time that the input pulse voltage of the signal 78 (FIG. 2) exceeds the reference voltage of the signal 86 (i.e., generally equal to the duration of the pulse of the first input signal 78). When the voltage amplitude of the first input signal 78 is less than the reference voltage of the second input signal 86, the output signal 46 of the comparator 82 is LOW. Thus, the reference voltage is a threshold value. FIG. 4 is a plot of the output signal 46 of the comparator 82 for the two inputs plotted in FIG. 3. At this point it is sufficient to note that the output pulses occur only when the voltage value of the input pulses (signal 78) exceed the threshold voltage value (signal 86). The significance of the cessation of the output pulses shown in FIG. 4 is discussed below.

The reference voltage at the second node 84 (FIG. 2) is the voltage across a capacitor 88 that is connected between the second node and electrical ground. Electrical energy is supplied to the second node 84 by a regulated voltage source voltage source Vcc (e.g., a battery of the vehicle 16 and regulation circuitry) connected to the second node 84 via a resistor 90. The first and second nodes 80 and 84 are connected together via a resistor 92.

A microprocessor 100 is provided. The microprocessor 100 has the capability to either draw current from or supply current to the second node 84. The microprocessor 100 is connected, via a line 102, to the second node 84 to monitor the reference voltage. A current-supply terminal 104 of the microprocessor 100 is connected to the second node 84 via a diode 106 and a resistor 108. A current-sink terminal 110 of the microprocessor 100 is connected to the second node 84 via a diode 112 and a resistor 114. Thus, the reference voltage of the second input signal 86 is controlled by the microprocessor 100. The current flow between the microprocessor 100 and the second node 84 can maintain the reference voltage at a desired level.

The current flow between the microprocessor 100 and the second node 84 can also change (increase or decrease) the reference voltage to a new level. Decreasing the reference voltage results in a weaker signal (i.e., with lower amplitude pulses) being permitted to "pass" the comparator 82. Increasing the reference voltage results in the opposite effect. This provides an ability to "accept" certain signals and to "ignore" other certain signals, dependent upon signal strength.

The strength of the transmitted signal 18 (FIG. 1) that is received at the receiver/controller unit 14 is dependent upon the distance between the transmitter unit 12 and the receiver/controller unit. The receiver/controller unit 14 can determine the strength of the transmitted signal 18 in accordance with the present invention. Determination of signal strength is useful to permit differentiation between whether a requested function, conveyed via the transmitted signal 18, will be performed or ignored.

The determination regarding signal strength is made during a start portion of the transmitted signal 18. The results of the strength determination are utilized during subsequent portions of the transmitted signal 18 (i.e., the security code and function request message portions).

The start portion includes a series of pulses that are identical and periodic. The start portion exists for a predetermined duration and each of the pulses exists for a predetermined duration. Accordingly, a predetermined number of pulses occur during the start portion. FIG. 3 illustrates a plot of an example of the signal 78 that is output from the carrier frequency processing circuitry 54 for the portion of time corresponding to the start portion. In the example of FIG. 3, the start portion exists for two-hundred (200) milliseconds and forty (40) pulses are provided within the start portion.

For any given distance between the transmitter unit 12 and the receiver/controller unit 14, the pulses of the signal 78 output from the carrier frequency processing circuitry 54 all have a given voltage value. In the example shown in FIG. 3, the pulses have a voltage value of 0.6 volts. In order to make the determination regarding signal strength, the receiver/controller unit 14 makes a determination of the voltage value of the signal 78.

As part of the structure for making the signal strength determination, the controller portion 48 includes an increment timer 120 and a threshold change trigger 122. The increment timer 120 is capable of timing relatively short time periods that exists for some duration less than the overall duration of the start portion of the transmitted signal 18. In the illustrated embodiment, the increment timer 120 is adapted to repeatedly decrement 20 millisecond durations.

The threshold change trigger 122 is operatively connected to the microprocessor 100 and communicates 124 with the microprocessor 100 during the start portion of the transmitted signal 18. For each timed duration provided by the increment timer 120, the threshold change trigger 122 causes the microprocessor 100 to provide one of a plurality of voltage level "steps" as of the threshold voltage at the second input signal 86. As each timed duration expires, the threshold change trigger 122 causes the microprocessor 100 to increase the threshold voltage to a next step. In the shown embodiment (see FIG. 3), the difference between each threshold voltage step is 0.1 volts. Accordingly, during the course of the start portion of the transmitted signal 18, the threshold voltage is stair-stepped from 0.1 volts to 1 volt, with each step coming at 20 millisecond intervals.

A count memory 126 (FIG. 2) is operatively connected to the microprocessor 52 of the controller portion 48 for counting output pulses (FIG. 4) that are seen by the microprocessor 52 in the output signal 46 of the comparator 82 during the start portion. The output pulses will occur so long as the pulses of the signal 78 exceed the threshold voltage at the second input signal 86. Thus, at some point during the start portion of the transmitted signal 18, the threshold voltage will be stepped up sufficiently high to exceed the voltage value of the pulses at the signal 78 and the output of the comparator 82 will be a steady state LOW.

The number of counted output pulses during the stair-stepping threshold change for the start portion is indicative of the strength of the transmitted signal 18. Specifically, the relative signal strength is related to:

$$\text{strength}=(\text{count}/p)*\Delta v$$

where:

count=number of comparator output pulses;

p=number of pulses in the start portion; and

Δv=voltage change increment for threshold voltage value.

In the illustrated example, there are forty (40) pulses during the start portion, and the threshold increment (Δv) is 0.1 volts. As shown by FIG. 4, the comparator 82 provides twenty (20) output pulses. Thus, the relative strength of the transmitted signal 18 in the example is:

$$\text{strength}=(20/40)*\ 0.1$$

strength=0.05

The controller portion 48 can then use the relative strength value to process and/or control the operation within the receiver/controller unit 14 for the rest of the transmitted signal that is to be received (i.e., the security code and the remote function request).

In one example, the controller portion 48 can cause the microprocessor 100 to adjust the threshold voltage value such that the rest of the transmitted signal will be effectively ignored by raising the threshold voltage value. As an alternative, the controller portion 48 can authorize or ignore certain functions based upon logic within the controller portion. For example, if the microprocessor 52 determines that the received function request is to unlock the vehicle doors, the microprocessor commands (authorizes) unlocking of the vehicle doors only if sufficient signal strength has been detected via the start portion of the transmitted signal 18. As another example, if the received function request is to lock the vehicle doors, the microprocessor commands (authorizes) locking of the doors regardless of the detected signal strength.

The precision with which the signal strength is determined during the start portion of the transmitted signal 18 is dependent upon the size of the threshold voltage change step (e.g., 0.1 volts), and the number of pulses within the start portion pulse string. Specifically, based upon the equation:

$$\Delta v*{}^{P}/_{M}=\text{maxvoltage}$$

where:

Δv=voltage change increment for the threshold;

p=number of pulses in the start portion;

m=maximum number of pulses that can occur during each threshold voltage step; and maxvoltage=the maximum voltage that is achieved during voltage stepping.

If it is assumed that K=P÷M, then K is the maximum number of steps to reach the maximum voltage level. Accordingly, reducing the size of the change in threshold voltage and shortening the length of each incremental time duration will result in an increase in the ability to determine exact signal strength.

Figure 5:
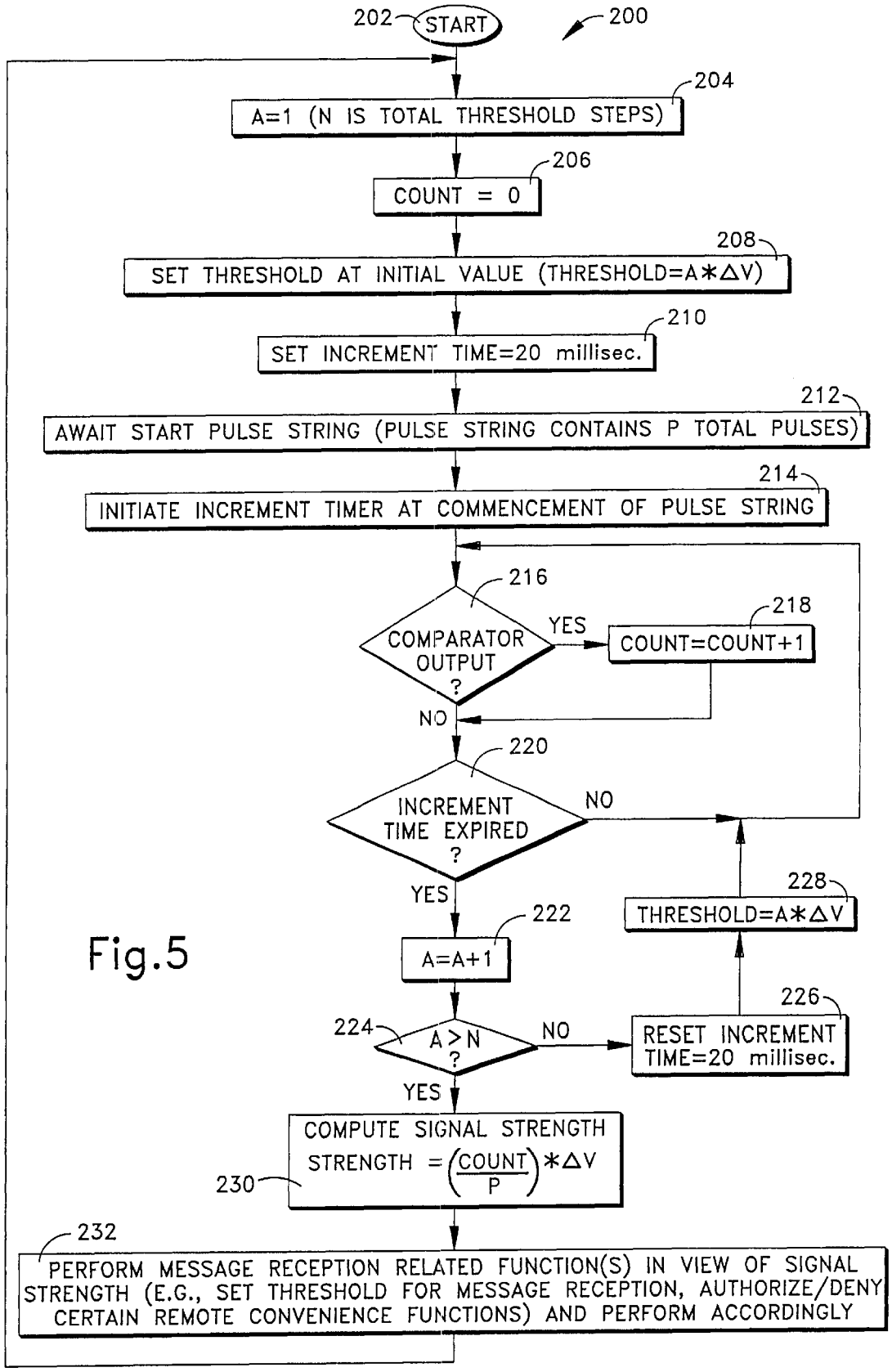
FIG. 5 is a flow chart for a process performed within the receiver/controller unit of FIG. 2.

FIG. 5 is an example of a process 200 performed within the controller portion 48. The process 200 is initiated at step 202 and proceeds to step 204, where a variable "A" is set equal to 1. The total number of threshold steps is "N". At step 206, a variable "count" is set equal to zero (0). At step 208, the threshold value is set equal to an initial value (i.e., the threshold value is equal to "A" multiplied by the threshold increment, Δv). In the illustrated example, the threshold increment Av is 0.1 volts and the initial threshold value is 0.1 volts. The increment timer 120 is set to 20 milliseconds in step 210.

At step 212, the receiver/controller unit 14 awaits the beginning of the start portion of the transmitted signal 18. It is to be recalled that the pulse string of the start portion contains "p" total pulses. As soon as the start portion begins (i.e., the receiver/controller unit 14 receives the very first pulse indicating the beginning of the transmitted signal 18), the increment timer 120 is initiated at step 214. At step 216, it is determined whether the comparator 82 provides an output pulse. Since the threshold value is set initially low, the comparator 82 will output a pulse and the determination at step 216 is affirmative.

Upon the affirmative determination at step 216 (i.e., an output pulse occurs), the process 200 goes to step 218 in which the "count" value in the count memory 126 is increased by one (1). Upon completion of step 218, the process 200 goes to step 220. It should be noted that if the determination at step 216 is negative (i.e., the comparator 82 does not output a pulse), the process 200 goes directly from step 216 to step 220.

At step 220, it is determined whether the time duration, which is being decremented by the increment timer 120, has expired. If the determination at step 220 is negative (the time has not yet expired), the process loops from step 220 to step 216, in which it is again determined whether the comparator 82 has output a pulse. The process 200 continues to loop through steps 216–220 for the duration of the increment time period. Each pulse of the output signal 46 from the comparator 82 results in the value of the variable "count" increasing by one (1).

If the determination at step 220 is affirmative (i.e., the increment time has expired), the process 200 goes from step 220 to step 222. At step 222, the variable "A" is increased by one (1). The increase of "A" by one is utilized to step the threshold value to the next incremental level. Specifically, at step 224, it is determined whether the value of "A" is greater than the value of "N"(i.e., whether "A" is greater than 10 in the illustrated example).

If the determination at step 224 is negative (i.e., "A" is less than "N" indicating that the stair-stepping of the threshold has not yet been completed), the process 200 goes to step 226 in which the increment time is reset to 20 milliseconds. The threshold voltage is set to the next increment. Specifically, the threshold is equal to value of "A" multiplied by the threshold increment Av (i.e., A×0.1 volts). From step 228, the process 200 goes to step 216. Thus, the process 200 continues in the nested loops provided by steps 216–228 until the stair stepping of the threshold voltage value is completed.

During the nested loops, the variable "count" continues to increase for each pulse in the output signal 46 of the comparator 82. However, at some point during the stair stepping, the threshold value will be increased such that the comparator 82 does not output any pulses. At that point in time, the variable "count" will not be increased for the rest of the stair stepping of the threshold value.

Upon an affirmative determination at step 224 (i.e., the stair-step incrementing is completed), the process 200 goes from step 224 to step 230. At step 230, the signal strength is computed. At step 232, the microprocessor 52 within the controller portion 48 performs message reception related functions in view of the determined signal strength. For example, the microprocessor 52 may authorize or ignore certain remote convenience function requests dependent upon the determined signal strength. Upon complete of step 232 (i.e., upon completion of reception of the transmitted signal 18 and appropriate action thereupon), the process 200 again returns to step 204. Steps 204–212 are performed and the next transmitted signal 18 is awaited at step 212.

From the above description of the invention, those skilled in the art will perceive improvements, changes an d modifications. Such improvements, changes and modifications within the skill of the art are intended to be covered by the appended claims.

Having described the invention, the following is claimed:

1. An apparatus for determining signal strength of a received electromagnetic signal comprised of a plurality of pulses that convey a remote convenience function request, and for causing performance of the requested function, said apparatus comprising:

a comparator having a first input for receiving an electrical signal with a voltage that varies to convey the remote convenience function request, a second input for receiving a threshold voltage value, and an output for providing an output signal indicative of the occurrence of the voltage of the electrical signal exceeding the threshold value;

means for adjusting the threshold voltage value; and means for monitoring the output signal of the comparator during adjustment of the threshold voltage value to determine strength of the electromagnetic signal;

wherein the output signal of said comparator has a pulse for each occurrence of the voltage of the electrical signal exceeding the threshold value, said means for monitoring includes means for counting the pulses of the output signal.

2. An apparatus as set forth in claim 1, including means for calculating strength of the electromagnetic signal using the counted pulses.

3. An apparatus as set forth in claim 2, wherein the electromagnetic signal has a start portion, the start portion has a predetermined number of pulses and exists for a predetermined duration, the predetermined duration is divided into a plurality of time increments, said means for adjusting includes means for increasing the threshold voltage value by a predetermined amount at an end of every time increment.

4. An apparatus as set forth in claim 3, wherein within said means for calculating, the signal strength is based upon:

$$\text{strength}=(\text{count}/p)*\Delta v$$

where:

count=number of comparator output pulses;

p=number of pulses in the start portion; and $\Delta v$=incremental change in threshold.

5. A method of determining signal strength of an electromagnetic signal, that is comprised of a plurality of pulses that convey a remote convenience function request and that is intended for causing performance of the requested function, said method comprising:

a comparing an electrical signal, that has a voltage which varies to convey the remote convenience function request, with a threshold voltage value;

outputting an output signal indicative of the occurrence of the voltage of the electrical signal exceeding the threshold value wherein the output signal has a pulse for each occurrence of the voltage of the electrical signal exceeding the threshold voltage value;

adjusting the threshold voltage value; and monitoring the output signal during adjustment of the threshold voltage value to determine strength of the electromagnetic signal wherein the step of monitoring the output signal includes the step of counting the pulses of the output signal.

6. An apparatus for determining signal strength of a received electromagnetic signal and for providing a strength signal indicative of the determined signal strength of the received electromagnetic signal, said apparatus comprising:

a comparator having a first input for receiving an electrical signal, a second input for receiving a threshold voltage value, and an output for providing an output signal indicative of the occurrence of the voltage of the electrical signal exceeding the threshold voltage value, the output signal of said comparator having a pulse for each occurrence of the voltage of the electrical signal exceeding the threshold value;

means for adjusting the threshold voltage value; and means for monitoring the output signal of the comparator during adjustment of the threshold voltage value to determine signal strength of the electromagnetic signal, said means for monitoring including means for counting the pulses of the output signal and means for providing a strength signal indicative of the signal strength of the electromagnetic signal in response to the counted pulses.

* * * * *